United States Patent [19]

Spring

[11] Patent Number: 4,713,101

[45] Date of Patent: Dec. 15, 1987

[54] COOLING APPARATUS

[75] Inventor: David J. Spring, Slough, England

[73] Assignee: Graviner Limited, Essex, England

[21] Appl. No.: 852,204

[22] Filed: Apr. 15, 1986

[30] Foreign Application Priority Data

Apr. 16, 1985 [GB] United Kingdom ..... 8509738
Dec. 9, 1985 [GB] United Kingdom ..... 8530306

[51] Int. Cl.[4] ..... F25J 1/00

[52] U.S. Cl. ..... 62/8; 62/52; 62/514 JT; 126/263

[58] Field of Search ..... 62/4, 8, 50, 52, 514 JT; 126/263

[56] References Cited

U.S. PATENT DOCUMENTS

| | | | |
|---|---|---|---|
| 2,746,264 | 5/1956 | Keyes | 62/92 |
| 2,990,699 | 7/1961 | Dennis | 62/511 |
| 3,640,083 | 2/1972 | Galbraith et al. | 62/52 |
| 3,726,649 | 4/1973 | Pelham | 23/281 |
| 3,877,882 | 4/1975 | Lette et al. | 23/281 |
| 3,920,575 | 11/1975 | Shiki et al. | 252/188.3 |
| 3,931,040 | 1/1976 | Breazeale | 252/188.3 R |
| 4,062,288 | 12/1977 | Millray | 102/39 |
| 4,080,802 | 3/1978 | Annable | 62/514 JT |
| 4,126,017 | 11/1978 | Bytniewski et al. | 62/514 JT |
| 4,255,157 | 3/1981 | Yamaguchi et al. | 126/263 |
| 4,376,002 | 3/1983 | Utracki | 149/35 |

FOREIGN PATENT DOCUMENTS

| | | |
|---|---|---|
| 0012626 | 6/1980 | European Pat. Off. . |
| 0012628 | 6/1980 | European Pat. Off. . |
| 2351401 | 5/1973 | Fed. Rep. of Germany . |
| 2193801 | 2/1974 | France . |
| 1148747 | 4/1969 | United Kingdom . |

OTHER PUBLICATIONS

Kirk-Othmer "Encyclopaedia of Chemical Technology, 3rd Edition, vol. 16, 1981, pp. 673-678.

*Primary Examiner*—Ronald C. Capossela
*Attorney, Agent, or Firm*—Leydig, Voit & Mayer

[57] ABSTRACT

A cooling apparatus comprises a chamber containing a pyrotechnic gas generating composition together with an igniter. When ignited, the gas generated by the composition is fed through filters where it is cooled to below the inversion temperature and it is then fed via a heat exchanger to a Joule-Thomson effect throttle where its temperature is further reduced. The gas output from the throttle is fed through a cool chamber where liquid gas collects. The outlet from the cool chamber is fed to the heat exchanger where it serves to reduce the temperature of the gas being fed to the throttle increasing the overall cooling effect.

13 Claims, 1 Drawing Figure

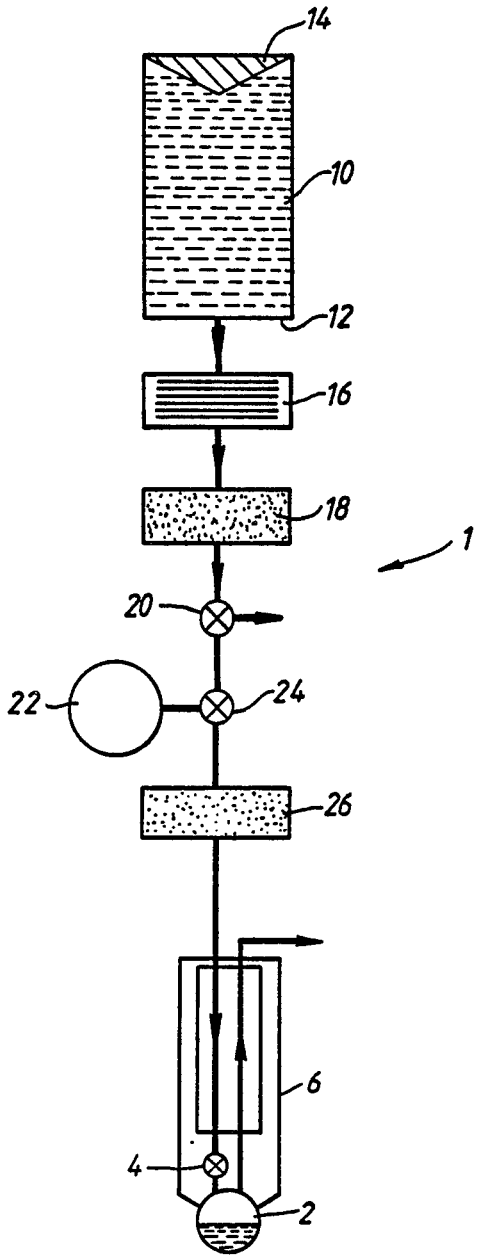
14
10
12
16
18
1
20
22
24
26
6
4
2

COOLING APPARATUS

BACKGROUND OF THE INVENTION

1. Technical Field

The present invention relates to cooling apparatus.

2. Prior Art

Various proposed cooling apparatus have taken advantage of the Joule-Thomson effect. In such coolers a gas is adiabatically throttled through an orifice from a high pressure to a low pressure. If the initial temperature of the gas is below its inversion temperature, then a fall in temperature takes place as the gas is passed through the orifice. Such a cooler requires a supply of high pressure gas since the fall in temperature of the gas in passing through the orifice is proportional to the drop in pressure.

Because of the need for a gas supply such cooling apparatus is mainly used in static applications.

In order for a Joule-Thomson effect cooler to work efficiently it is necessary for the gas which is throttled to be particularly pure because the orifice through which it is throttled has to be small and is therefore easily blocked by foreign bodies or impurity gases and vapours which freeze in the orifice. For instance if nitrogen is used no carbon dioxide can be present as this may freeze. Likewise water is also to be avoided not only because its freezing can block the throttle but also because its expansion on freezing can damage the cooler.

To make such a cooler portable, a high pressure cylinder of gas could be used. However this is a relatively heavy and bulky way of transporting the gas.

SUMMARY OF THE INVENTION

An object of the present invention is to provide a portable Joule-Thomson effect cooler which may be used in situations where weight and volume are significant considerations.

The present invention accordingly provides a Joule-Thomson effect cooler comprising a throttle for receiving a supply of high pressure gas, a cool chamber connected to the outlet of said throttle, a gas outlet from the cool chamber passing through a heat exchanger adapted to cool the gas input to the throttle, a chemical pyrotechnic composition for generating a pure gas, means for activating said composition to initiate gas generation, and filter means connected between said gas generating composition and the inlet to said throttle.

By using a gas-generating composition, significant savings in space and weight can be achieved. The arrangement is particularly advantageous where relatively small quantities of gas are required to produce a significant cooling effect over a short period of time.

Examples of suitable gas-generating compositions are azide compositions comprising sodium azide together with a compound adapted to react with sodium, or chlorate compositions. The former compositions generate nitrogen whereas the latter compositions generate oxygen.

BRIEF DESCRIPTION OF THE DRAWING

Some embodiments of the invention will now be described, by way of example only, with reference to the accompanying diagrammatic representation of a Joule-Thomson effect cooler in accordance with the present invention.

DESCRIPTION OF PREFERRED EMBODIMENTS

The illustrated cooler 1 is intended to produce a cool chamber 2 which contains liquified gas and which can cool a surrounding material by conduction.

The inlet to the chamber 2 is via a Joule-Thomson throttle 4 to which gas is supplied through a heat exchanger 6. Gas leaving the throttle 4 via the cool chamber 2 is also passed through the heat exchanger 6 before being vented to atmosphere.

The gas which is to be fed to the Joule-Thomson throttle 4 is generated by means of a pyrotechnic composition 10 stored in a chamber 12. The chamber 12 also houses an igniter 14 for the pyrotechnic composition such as an electrical igniter. Instead, or in addition, a percussion igniter may be used. Another possibility is to use a pyrotechnic-type igniter. Once ignition has taken place, the gas generated by the composition 10 is fed through a filter 16 which performs the dual function of removing any particulate matter and also cooling the gas, which is normally generated at high temperatures, to below its inversion temperature.

This filter 16 can consist of a number of layers of metal gauzes or baffle or, more advantageously, it is a porous sintered metal filter.

The filtered and cooled gas leaving the filter 16 is fed through a further filter 18 made up of a molecular sieve, e.g. a zeolite aluminosilicate mineral, or other materials, such as activated carbon, activated alumina or soda lime. The filter 18 removes traces of water, carbon dioxide and ammonia and other contaminants which could freeze in the throttle. The filter 18 is optional and may be omitted if the presence of water and carbon dioxide is not a problem for a particular gas-generating composition 10.

For removal of traces of ammonia from the gas, it can be advantageous to use, in filter 18, molecular sieves whose exchangeable alkali metal cations, such as $Na^+$ and $K^+$ have been replaced, using methods well known to the art, by transition metal cations such as $Co^{2+}$, $Cu^{2+}$, $Cr^{3+}$ etc. Such exchanged molecular sieves have a greater affinity for ammonia and can remove it more efficiently from the gas stream.

The gas is then passed through a pressure release valve 20 before reaching the heat exchanger 6 and, subsequently the throttle 4.

A gas reservoir 22 is also provided so that gas may be diverted to the reservoir via a 3-way valve 24 instead of to the heat exchanger 6 and throttle 4 if no further or a delayed cooling effect is required.

A further filter 26, made up of molecular sieves or other trace impurity removing substances, may be interposed between the valve 24 and the cooler. This filter 26 in the position shown in the drawing downstream of valve 24 allows any impurities which are introduced into the gas stream from the reservoir 22 to be removed. The use of this filter is not essential.

It will be appreciated that the control features such as valves 20 and 24 and reservoir 22 provided for the gas as it passes to the throttle may be varied depending on the exact purpose of the cooler so that the gas flow is controlled to produce the desired cooling effect at the appropriate time.

Many pyrotechnic gas-generating compositions are known but not all would be suitable for use in such a cooler as they typically generate significant quantities of water and/or carbon dioxide. For this reason azide compositions or chlorate compositions which generate nitrogen and oxygen respectively, have been selected as preferred, although any other composition which generates a relatively pure gas in a safe manner could be utilised if the gas possesses the appropriate properties for Joule-Thomson effect coolers.

Azide compositions comprise one or more alkali metal or alkine earth metal azides, usually including sodium azide as a major component, together with an oxidising agent. When heated above 600K sodium azide decomposes producing nitrogen gas and sodium metal:

$$2NaN_3=2Na+3N_2$$

Because of the low melting point of sodium metal, its presence is undesirable from a safety viewpoint. Various substances, such as one or more metal oxides, particularly transition metal oxides or alkali metal perchlorates, have been proposed for use as the oxidising agent to be combined with the sodium azide in order to react with the sodium and produce inert compounds which will not contaminate the nitrogen. For example the sodium azide may be combined with ferric oxide to produce a reaction as follows:

$$6NaN_3+Fe_2O_3=2Fe+3Na_2O+9N_2$$

A doped ferric oxide may instead be used to produce a reaction similar to that referred to above.

Another possibility is to use chromium chloride producing a reaction as follows:

$$6NaN_3+2CrCl_3=2Cr+6NaCl+9N_2$$

Cobalt oxide may instead be used which produces a reaction as follows:

$$6NaN_3+Co_2O_3=2Co+3Na_2O+9N_2.$$

Another possibility is to use nickel oxide producing a reaction as follows:

$$2NaN_3+NiO=Ni+2Na_2O+3N_2$$

Certain metal oxides are also added to the basic compositions in order to provide a flux which binds the residual solids together and reduces smoke formation. Typical of such additives are silica, titanium dioxide, aluminum oxide, and boric oxide. An example of such a composition is as follows:

sodium azide 64%
ferric oxide 26%
silica 10%

Additives may also be incorporated in the composition for the purpose of producing a purer evolved gas.

Thus, for example, the silica in the above composition may be replaced, in whole or in part, by powdered activated molecular sieve, and this latter may be transition metal exchanged as described earlier, in order to reduce the amount of ammonia evolved. Certain additional transition metal oxides may also be used for this purpose, e.g. $Cr_2O_3$, $Co_3O_4$, $Fe_3O_4$ etc.

Compositions based on an alkali metal chlorate such as sodium chlorate are also suitable for use in the cooler of the present invention. Such combinations typically comprise (besides sodium chlorate) some iron powder to act as a fuel in order to sustain the combustion process together with small amounts of barium peroxide to suppress chlorine formation. Glass fibre is typically included as a binder. One composition that would be suitable is as follows:

Sodium chlorate 80–85%
Iron powder 3–10%
Barium peroxide 4%
Glass fibre binder rest The reactions involved in utilising compositions of this sort are as follows:

$$2NaClO_3=2NaCl+3O_2$$

$$4Fe+3O_2=2Fe_2O_3$$

Further details of compositions of this type may be found in the Encyclopedia of Chemical Technology, 3rd edition, pages 658–663, published by Wiley-Interscience.

Where the selected gas generating composition is a slow-burning one it is preferable to include a proportion of a more easily ignitable composition to assist in establishing ignition of the slow-burning composition by the igniter 14.

I claim:

1. A Joule-Thomson effect cooler including a supply of high pressure gas having an outlet, said supply including a chemical, pyrotechnic composition operable to generate a pure gas, and a device operatively associated with said composition to initiate combustion thereof and thereby to initiate gas generation from said composition and supply of said gas from said outlet, the temperature of the gas being above its inversion temperature, a throttle having an inlet and an outlet, a cool chamber having an inlet connected to the outlet of said throttle, and an outlet, a heat exchanger operatively connected to cool the gas passing to said inlet of said throttle, said heat exchanger being operatively connected to said outlet from said cool chamber, and filter means operatively connecting said outlet of said gas supply to said inlet of said throttle, the filter means performing a cooling as well as a filtering action and cooling the gas to below its inversion temperature, whereby the gas arriving at the inlet of the throttle is free of impurities capable of significantly reducing flow through said throttle.

2. A cooler according to claim 1, wherein the gas generating composition generates nitrogen.

3. A cooler according to claim 2, wherein the gas generating composition includes a mixture of one or more alkali metal or alkaline earth metal azides, preferably sodium azide, combined with an oxidising agent selected from one or a mixture of two or more metal oxides, preferably transition metal oxides, especially ferric-oxide, or alkali metal perchlorates.

4. A cooler according to claim 2, wherein the gas generating composition further includes at least one or more of silica, titanium dioxide, boric oxide and aluminium oxide.

5. A cooler according to claim 1, wherein the gas generating composition is a mixture of sodium azide, ferric oxide and silica.

6. A cooler according to claim 1, wherein the gas generating composition generates oxygen.

7. A cooler according to claim 6, wherein the gas generating composition includes one or more alkaline metal chlorate, preferably sodium chlorate, a metal fuel and means for controlling chlorine production.

8. A cooler according to claim 1, wherein the filter means include at least one molecular sieve of zeolite aluminosilicate mineral, activated carbon, activated alumina, soda lime or similar materials, for removing traces of water, carbon dioxide and ammonia.

9. A cooler according to claim 8, wherein the molecular sieve material has exchangeable alkali metal cations which have been replaced by transition metal cations.

10. A cooler according to claim 1, wherein the device for initiating combustion includes percussion means.

11. A cooler according to claim 1, wherein the device for initiating combustion includes electrical means.

12. A cooler according to claim 1, wherein the device for initiating combustion includes pyrotechnic means.

13. A method of cooling including the steps of pyrotechnically activating a gas generating composition for generating substantially pure oxygen or nitrogen at a pressure sufficient to operate a Joule-Thomson cooler and at a temperature above the inversion temperature of the gas, filtering the generated gas and at the same time cooling the gas to below its inversion temperature, and passing the gas through a Joule-Thomson throttle at said high pressure to produce a liquefied gas for cooling purposes, the gas arriving at the said throttle being free of impurities capable of significantly reducing the flow through said throttle.

* * * * *